US006637484B1

(12) United States Patent
Kraft

(10) Patent No.: US 6,637,484 B1
(45) Date of Patent: Oct. 28, 2003

(54) MOBILE TECHNOLOGY ORGANIZER HANDBAG

(76) Inventor: Kerri Kraft, 219 Brannan St., #7G, San Francisco, CA (US) 94107

( * ) Notice: Subject to any disclaimer, the term of this patent is extended or adjusted under 35 U.S.C. 154(b) by 0 days.

(21) Appl. No.: 10/003,744

(22) Filed: Oct. 31, 2001

(51) Int. Cl.[7] ..... A45C 3/06; A45C 13/26

(52) U.S. Cl. ..... 150/112; 150/106; 150/107; 150/118; 206/320; 224/930

(58) Field of Search ..... 150/106, 112, 150/113, 110, 118, 134, 147, 148, 107; 206/320; 190/102, 109; 224/930

(56) References Cited

U.S. PATENT DOCUMENTS

| | | | | | |
|---|---|---|---|---|---|
| 1,560,442 | A | * | 11/1925 | Trowbridge | 150/112 |
| 1,999,669 | A | * | 4/1935 | Smith | 150/113 |
| 2,117,989 | A | * | 5/1938 | Ryan | 150/110 X |
| 2,413,465 | A | | 12/1946 | Ohlsen | 150/117 |
| 2,464,312 | A | * | 3/1949 | Holden | 150/113 |
| 2,467,662 | A | * | 4/1949 | Freigerg | 150/117 |
| 2,477,388 | A | * | 7/1949 | Moore | 150/112 |
| 2,608,228 | A | * | 8/1952 | Rose | 150/112 |
| 2,612,199 | A | | 9/1952 | Schocket | 150/112 |
| 3,294,136 | A | * | 12/1966 | Cain et al. | 150/106 |
| 3,958,616 | A | * | 5/1976 | Beverstock | 150/113 X |
| 4,004,325 | A | * | 1/1977 | Hubachek | 150/106 X |

(List continued on next page.)

FOREIGN PATENT DOCUMENTS

| | | | | |
|---|---|---|---|---|
| CA | 546195 | * | 9/1957 | 150/112 |
| FR | 607394 | * | 7/1928 | 150/110 |
| FR | 966288 | * | 10/1950 | 150/112 |

OTHER PUBLICATIONS

U.S. patent application Publication No. 2001/0027834 A1, dated Oct. 2001, to Southwick for "Wallet/Handbag System with External Phone Pocket".*

*Primary Examiner*—Sue A. Weaver
(74) *Attorney, Agent, or Firm*—Reinhart Boerner Van Deuren s.c.

(57) ABSTRACT

An improved handbag is disclosed which includes an enclosure having opposed front (3) and rear panels (6), opposed side gussets (5), a bottom panel (8) and a top opening (7) defined opposite the bottom panel (8). The top opening (7) is twice the width of the bottom panel to provide easy viewing and access into a main compartment. A hinged closure flap (10) is provided for covering and securing the main compartment and its contents. When the closure flap (10) is in the closed position, the handbag has a sleek and classically styled exterior appearance. A series of storage pockets (16, 17, 18, 19, 20, 41, 42, 43, 44, 45) are arranged upon the interior front (3) and rear panels (4) to facilitate selective filling of the pockets with essentials such as mobile technology products, keys, and multiple forms of currency and identification. The remaining main compartment is used for storing the user's unique items. The series of pockets are all cooperating to provide the mobile person with a simplified handbag that provides easy viewing and access, with one hand, while the handbag remains on the user's shoulder.

13 Claims, 4 Drawing Sheets

U.S. PATENT DOCUMENTS 4,037,633 A * 7/1977 Gordon ..... 150/110
4,153,093 A * 5/1979 Mahabir ..... 150/106 X
4,161,201 A 7/1979 Carp ..... 150/35
4,192,365 A 3/1980 Siegel ..... 150/35
4,515,493 A * 5/1985 Radovich ..... 150/110 X
4,739,809 A 4/1988 Adams ..... 150/112
4,801,059 A * 1/1989 Hayes ..... 150/110 X
4,860,563 A * 8/1989 Gerch ..... 150/106 X
5,048,582 A * 9/1991 Whitfield ..... 150/112
5,207,254 A * 5/1993 Fromm ..... 150/113 X
5,597,256 A * 1/1997 Burton et al. ..... 402/4
5,719,936 A * 2/1998 Hillenmayer ..... 379/447
5,749,447 A 5/1998 Hersh et al. ..... 190/112
5,829,502 A 11/1998 Distefano et al. ..... 150/113
5,881,788 A * 3/1999 Hersh et al. ..... 150/146 X
5,983,969 A * 11/1999 Morgan ..... 150/113 X
6,029,724 A * 2/2000 Rudnick ..... 150/145 X
6,047,752 A 4/2000 Southwick ..... 150/117
6,126,012 A * 10/2000 Roegner ..... 150/112 X
6,152,202 A 11/2000 Magid ..... 150/112
6,193,034 B1 * 2/2001 Fournier ..... 190/107
6,283,183 B1 9/2001 Cooper ..... 150/112
6,357,646 B1 * 3/2002 Gur et al. ..... 224/683 X

* cited by examiner

MOBILE TECHNOLOGY ORGANIZER HANDBAG

BACKGROUND

1. Field of Invention

This invention relates to handbags, specifically to an improved organizer handbag.

2. Discussion of Prior Art

Organizer handbags of various styles and compartmental configurations can be found in prior art. These organizer handbags provide various pockets to carry personal items such as money, cosmetics, cell phones, keys and other such articles. However, all fail to simultaneously address the busy, fashion conscious woman who strives to simplify her life while juggling family and career. For women who are simplifying their lives, reducing clutter and becoming more efficient are priorities. Therefore, the number of personal items is being minimized and more focus is being placed on essential items including mobile technology such as cell phones and Personal Digital Assistants. For example, when a woman leaves her home the critical essentials can be the keys to her home and transportation; currency in various forms such as checkbook, credit card and cash for unexpected purchases; identification such as a drivers license or passport if traveling to a foreign country; a cell phone for constant communications with family, friends, co-workers and clients; and a Personal Digital Assistant for critical information such as appointments, addresses and phone numbers. These items allow the mobile woman to move freely and efficiently from various locations throughout the day with minimal, yet critical essentials. The following prior art are distinguishable from the invention disclosed herein and are noted below and in Objects and Advantages.

U.S. Pat. No. 6,283,183 B1: This prior art contains a multitude of compartments that can be used for various purposes so it may not be intuitive to the user what to use each compartment for. This handbag does not have a pocket with a specific size and configuration of a Personal Digital Assistant, a common mobile technology increasingly carried by multi-tasking, mobile women. This handbag does not have a cell phone pocket with a specific size and configuration that allows for a quick, single-hand, retrieval and replacement of a cell phone. Mobile women who juggle both career and family increasingly use cell phones to maintain contact with family, friends, co-workers and clients. Therefore, simplifying access to a device that can be used constantly throughout each day can eliminate the frustration of rummaging through the handbag, especially when the phone is ringing. This handbag does not have a compartment to hold a cell phone headset, which is becoming more common for health and safety reasons. This handbag does not have the capability to hold over twenty credit card sized items in a manner that allows for quick and easy viewing. The average woman who juggles both career and family can carry over twenty credit card sized items including business cards, identification, frequent flyer cards from multiple airlines, hotel cards from multiple hotels, gasoline cards, phone cards, and healthcare cards. Since most women typically do not need to access more than a few cards throughout each day, a convenient storage place that does not affect the access of items needed on a daily basis can be important. However, in cases when the woman is traveling outside of the local area it can be important to quickly and easily access frequent flyer cards, car rental cards, hotel cards and credit cards to reduce frustration of sorting through a stack of cards by hand.

U.S. Pat. No. 6,047,752: This prior art does not have a pocket with a specific size and configuration of a Personal Digital Assistant, a common mobile technology increasingly carried by multi-tasking, mobile women. This handbag does not have a cell phone pocket with a specific size and configuration that allows for a quick, single-hand, retrieval and replacement of a cell phone. Mobile women who juggle both career and family increasingly use cell phones to maintain contact with family, friends, co-workers and clients. Therefore, simplifying access to a device that can be used constantly throughout each day can eliminate the frustration of rummaging through the handbag, especially when the phone is ringing. This handbag does not have a compartment to hold a cell phone headset, which is becoming more common for health and safety reasons.

U.S. Pat. No. 4,192,365: This prior art contains a multitude of compartments that can be used for various purposes so it may not be intuitive to the user what to use each compartment for. This handbag does not have a pocket with a specific size and configuration of a Personal Digital Assistant, a common mobile technology increasingly carried by multi-tasking, mobile women. This handbag does not have a cell phone pocket with a specific size and configuration that allows for a quick, single-hand, retrieval and replacement of a cell phone. Mobile women who juggle both career and family increasingly use cell phones to maintain contact with family, friends, co-workers and clients. Therefore, simplifying access to a device that can be used constantly throughout each day can eliminate the frustration of rummaging through the handbag, especially when the phone is ringing. This handbag does not have a compartment to hold a cell phone headset, which is becoming more common for health and safety reasons. As currency can be something that a mobile woman must access throughout each day, this handbag does not have a centrally located set of compartments that provide easy access and viewing of multiple forms of currency such as paper bills, coins, credit cards and checkbook.

U.S. Pat. No. 6,152,202: This prior art contains a multitude of compartments that can be used for various purposes so it may not be intuitive to the user what to use each compartment for. This handbag does not have a pocket with a specific size and configuration of a Personal Digital Assistant, a common mobile technology increasingly carried by multi-tasking, mobile women. This handbag does not have a cell phone pocket with a specific size and configuration that allows for a quick, single-hand, retrieval and replacement of a cell phone. Mobile women who juggle both career and family increasingly use cell phones to maintain contact with family, friends, co-workers and clients. Therefore, simplifying access to a device that can be used constantly throughout each day can eliminate the frustration of rummaging through the handbag, especially when the phone is ringing. This handbag does not have a compartment to hold a cell phone headset, which is becoming more common for health and safety reasons. This handbag does not have a compartment for a quick and easily accessible key ring holder. This can be important for reducing the frustration and increasing the safety of multi-tasking women who must rummage through their handbag to find their keys. This handbag does not have the capability to hold over twenty credit card sized items in a manner that allows for quick and easy viewing and storage. The average woman who juggles both career and family can carry over twenty credit card sized items including business cards, identification, frequent flyer cards from multiple airlines, car rental cards, hotel cards, gasoline cards and healthcare cards. Since most women typically do not need to access more than a few cards throughout each day, a convenient storage place that does not affect the access of items needed on a daily basis can be important. However, in cases when the woman is traveling outside of the local area it can be important to quickly and easily access frequent flyer cards, car rental cards, hotel cards and credit cards to reduce frustration of sorting through a stack of cards by hand. This handbag does not have a simplified way for a multi-tasking woman to open and close the handbag with one hand in a single, swift movement.

U.S. Pat. No. 5,829,502: This prior art contains a multitude of compartments that can be used for various purposes so it may not be intuitive to the user what to use each compartment for. This handbag does not have a pocket with a specific size and configuration of a Personal Digital Assistant, a common mobile technology increasingly carried by multi-tasking, mobile women. This handbag does not have a cell phone pocket with a specific size and configuration that allows for a quick, single-hand, retrieval and replacement of a cell phone. Mobile women who juggle both career and family increasingly use cell phones to maintain contact with family, friends, co-workers and clients. Therefore, simplifying access to a device that can be used constantly throughout each day can eliminate the frustration of rummaging through the handbag, especially when the phone is ringing. This handbag does not have a compartment to hold a cell phone headset, which is becoming more common for health and safety reasons. This handbag does not have a compartment for a key ring holder. This can be important for reducing the frustration and increasing the safety of multi-tasking women who must rummage through their handbag to find their keys. This handbag does not have a simplified means for a multi-tasking user to open and close the handbag with one hand in a single, swift movement.

U.S. Pat. No. 6,047,752: This prior art contains a multitude of compartments that can be used for various purposes so it may not be intuitive to the user what to use each compartment for. This handbag does not have a pocket with a specific size and configuration of a Personal Digital Assistant, a common mobile technology increasingly carried by multi-tasking, mobile women. This handbag does not have a compartment to hold a cell phone headset, which is becoming more common for health and safety reasons. This handbag has exposed pockets that add unsightly bulges to the handbag and increase the chance of theft or accidental loss of valuable wireless technology devices.

OBJECTS AND ADVANTAGES

Accordingly, several objects and advantages of my invention are:

(a) to provide a handbag that has compartments with specific sizes and configurations for the mobile, multi-tasking woman who relies on quick and easy access to wireless technology, multiple forms of currency, identification, and keys throughout each day.

(b) to provide a handbag with ample space for women to carry their unique, personal items.

(c) to provide a handbag with a pocket of a specific size and configuration for quick retrieval and replacement of a Personal Digital Assistant. This can be important for women who are simplifying their lives by replacing paper with a Personal Digital Assistant that contains all critical information needed on a daily basis including appointment times and places, addresses, and phone numbers.

(d) to provide a handbag with a pocket of a specific size and configuration for a quick, single-hand retrieval and replacement of a cell phone. Women who juggle both career and family can use cell phones to provide instant communication to family, friends, clients and co-workers throughout each day. Quick access to a ringing phone can help reduce frustration and allow women to maintain focus on the task that was at hand when the phone rang.

(e) to provide a handbag with a pocket of a specific size and configuration for holding a cell phone headset, placed close to the cell phone. The use of cell phone headsets is more common now that industry and government officials have raised concern of the potential dangers of radiation. In addition, cell phone headsets provide hands free communications when driving an automobile.

(f) to provide a handbag with a classic exterior style for fashion conscious women who must quickly transition from day to evening events. The handbag can transition from an office business environment to dinner at a nice restaurant while keeping essentials out of sight but close at hand. This can be especially important for women who travel and want to simplify the amount of clothing and accessories to be packed.

(g) to provide a handbag for women that will open and close with one hand in a single, swift movement. This can be important for the busy, multi-tasking woman who typically has only one hand free when moving from one location to another. With a free hand the woman can open the handbag with one movement, quickly view all contents, and access contents with the same hand.

(h) to provide a handbag for multi-tasking women that has an opening wider than the bottom panel. This can be important for women on the go. For example, a woman is walking and talking on the cell phone at the same time and needs to access her primary credit card and her Personal Digital Assistant to provide an address to the person she is talking to. The woman can flip open the top of the handbag with one hand. Since the opening is wider than the base plenty of light is allowed in to reflect on all contents. The woman can continue walking and talking while viewing the contents as well as extracting the needed items.

(i) to provide a handbag with an interior key chain holder that resides near the top opening but in the middle of the handbag to ensure quick access to keys. By placing the key holder at the top opening of the bag, women can access their keys in one swift movement. This can be important for women who are in unfamiliar places and need to keep their focus on what and who is around them rather than rummaging through their handbag. The placement of the key holder in the middle of the rear handbag panel can ensure that the handbag maintains an even balance when it is carried on the shoulder. This can be especially important for women who carry a large number of keys. The weight of the keys can tilt the handbag to one side causing the handbag to constantly shift and slip off the shoulder.

Further objects and advantages are to provide a handbag without exterior pockets and with a closure that eliminates exposure of the interior contents to help reduce the chance of theft or accidental loss of contents. Still further objects and advantages of my invention will become apparent from a consideration of the drawings and ensuing description.

SUMMARY

In accordance with the present invention, an improved organizer handbag is provided having a plurality of pockets sized and configured to accommodate mobile technology such as a Personal Digital Assistant, cell phone and cell phone headset; financial components such as a checkbook, paper currency, coins and credit cards; identification such as a drivers license and passport; and a key ring. The handbag comprises a pair of opposed panels which are joined at a bottom panel and are movable from a position in close proximity to each other to an open position that is wider than the bottom panel allowing for easy viewing and access to contents. Each of the panels has an outer surface and an inner surface, with a series of pockets arranged on the inner surfaces. A closure flap, in the closed position, covers the opening of the handbag and its contents. A shoulder strap attached to the closure flap allows the bag to be carried, hands-free. The opening and series of pockets are all cooperating to provide the mobile person with a simplified handbag that provides quick and easy viewing and access of contents, with one hand, while the bag remains on the user's shoulder.

DRAWINGS

Drawing Figures

In the drawings, wherein like reference numerals are employed to designate like parts:

REFERENCE NUMERALS IN DRAWINGS

Figure 1:
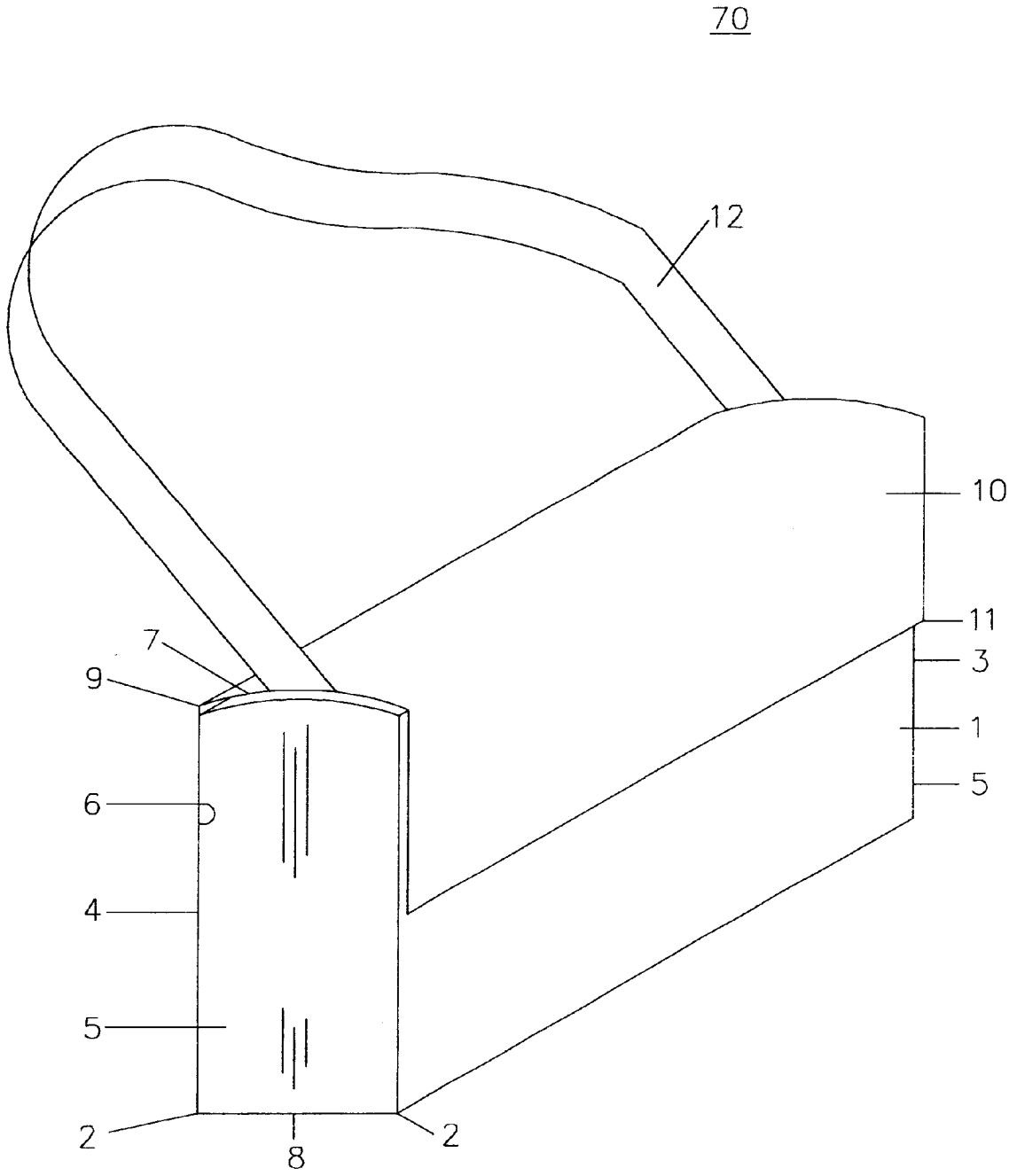
FIG. 1 is a perspective view of a preferred embodiment of the handbag in the present invention.

1 outer side front panel
2 bottom ends
3 inner side front panel
4 outer side rear panel
5 side gusset
6 inner side rear panel
7 top opening
8 bottom panel
9 upper edge rear panel
10 closure flap
11 lower edge closure flap
12 shoulder strap
13 underside closure flap
14 magnetic snap closure half
15 cooperative snap closure half
16 first pocket
17 second pocket
18 third pocket
19 loop
20 hook
25 removable two-sided cardholder
26 credit card pockets
27 flap
28 top of inner side rear panel
31 intermediate
33 back panel side edge
34 front panel side edge
35 cardholder front panel
36 cardholder rear panel
37 cardholder top edge
38 cardholder side edge
39 cardholder bottom edge
41 fourth pocket
42 fifth pocket
43 sixth pocket
44 seventh pocket
45 pockets
46 zipper type fastening mechanism

DETAILED DESCRIPTION OF THE PREFERRED EMBODIMENT

In FIG. 1, there is shown the handbag 70 of the present invention in accordance with one embodiment. The handbag is of the type that can be used by a woman carrying various articles such as a Personal Digital Assistant, pager, cell phone, keys, credit cards, coins, paper currency, check book, passport, etc.

The present invention provides a plurality of pockets, each sized and configured for specific items. The pockets are attached to the inner side front panel 3 and the inner side rear panel 6 so that each item is readily accessible to the user of the handbag.

Figure 2:
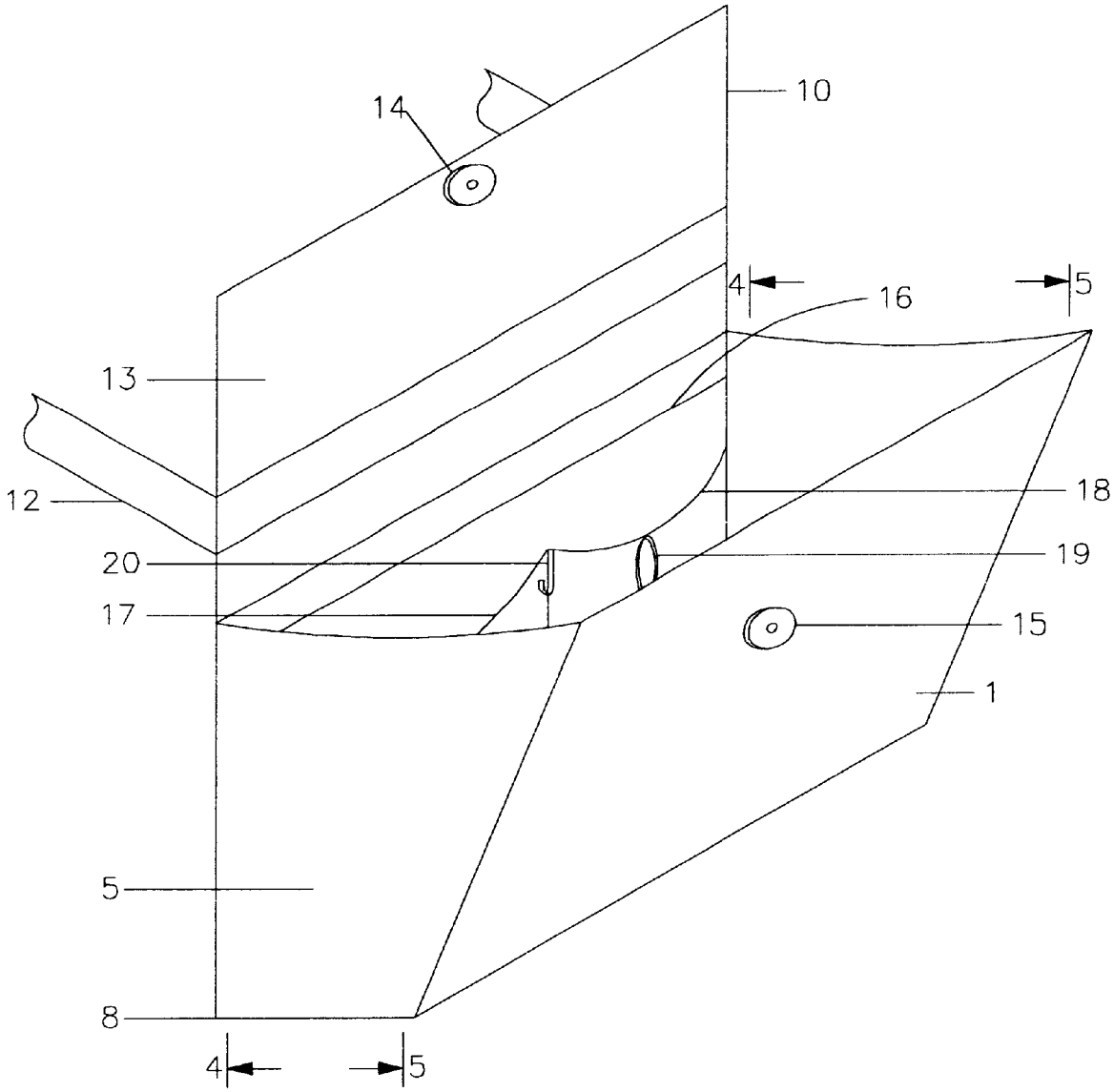
FIG. 2 is a perspective view of the handbag in the open position.

A more specific description of the handbag 70 will now be provided. For the handbag shown in FIG. 1, there is one outer side front panel 1, one outer side rear panel 4, one inner side front panel 3, one inner side rear panel 6, two side gussets 5 and one bottom panel 8. There is a top opening 7 opposite the bottom panel 8. A shoulder strap 12 is secured to an underside closure flap 13 for carrying the bag, as shown in FIG. 2. The inner side front panel 3 and the inner side rear panel 6 are connected together at their bottom ends 2 for a pivotal movement relative to each other. To create a main compartment when the bag is open, side gussets 5 connect the bottom panel 8 and the vertical edges of the inner side front panel 3 and inner side rear panel 6. A closure flap 10 is hingedly affixed to an upper edge rear panel 9. A closure flap 10 is folded over the top opening 7 and outer side front panel 1 for the closed position as illustrated in FIG. 1. The closure flap 10 lies in juxtaposition when closed covering a substantial portion of the outer side front panel 1 and all interior contents. A lower edge closure flap 11 may be scalloped or contoured as shown to present an aesthetically pleasing appearance. As shown in FIG. 2 a magnetic snap closure half 14 is carried on the inner side of the closure flap 10. A cooperative snap closure half 15 is secured to the middle of the outer side front panel 1. When the snap closures 14 and 15 are engaged the closure flap 10 is in the secured, closed position.

In keeping with the present invention, FIG. 2 shows the shoulder strap 12 attached by stitching or heat bonding to the middle of the underside closure flap 13. The top opening 7 is substantially wider than the bottom panel 8 to provide streamlined viewing and access to interior contents. The handbag 70 is preferably formed from a microfiber-type material or various suitable materials such as leather. Stitching, heat bonding, or other methods known in the art may join the panels. The panels may be reinforced with a relatively rigid or semi-rigid backing material such as cardboard, vinyl, or the like.

The handbag has a number of internal compartments for holding various personal items such as a cell phone, Personal Digital Assistant, pager, credit cards, paper currency, checkbook, passport, and coins which compartments are easily accessible through the top opening 7 of the handbag. The internal compartments are attached to the inner side panels 3 and 6 and are of varying widths and depths.

Figure 4:
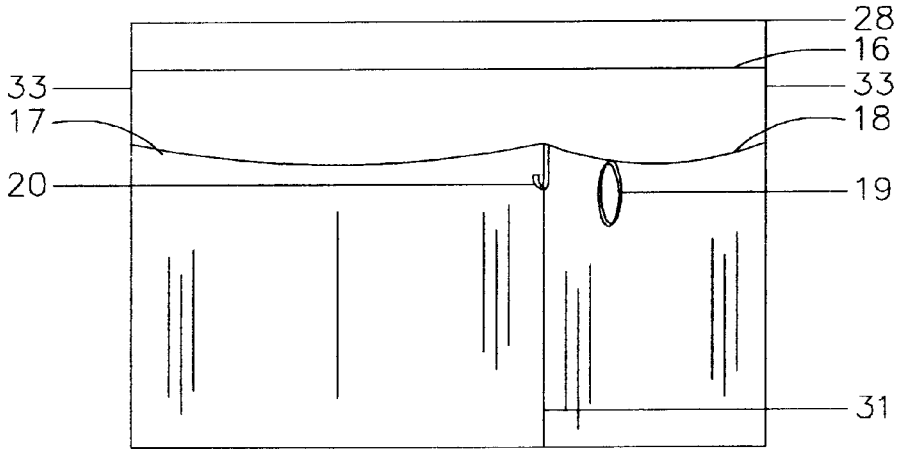
FIG. 4 is a sectional view taken along line 4—4 of FIG. 2.

The details of the inner side rear panel 6, as shown in FIG. 4, are now discussed. Within the interior compartment and attached to the inner side rear panel 6 is a first pocket 16 for holding a removable two-sided cardholder 25, shown in FIG. 6. First pocket is an elongated strip, having four peripheral edges, three of which are permanently attached to the inner side rear panel 6. The first pocket 16 is substantially lower than the top of inner side rear panel 28 to ensure easy access to contents.

Overlaying the first pocket 16 is a second pocket 17 and a third pocket 18. The second pocket 17 is formed by an elongated strip which at its ends is secured to the back panel side edge 33, the bottom panel 8, and intermediate 31 to define an upwardly opening that is substantially lower than the first pocket 16. The third pocket 18 is formed by a second elongated strip and is secured to the back panel side edge 33, the bottom panel 8, and intermediate 31 to define an upwardly opening that is even with the upwardly opening of the second pocket 17. The distance from the second pocket 17 back panel side edge 33 to the intermediate 31 is substantially greater than the distance from the third pocket 18 back panel side edge 33 to the intermediate 31 to accommodate the size and configurations of a standard Personal Digital Assistant and Cell Phone, respectively. A one-way stretch fabric of nylon is used to securely, yet flexibly, hold the devices while allowing for quick and easy extraction and replacement of the devices. The second pocket 17 may also accommodate a pager. The pager can be stored inside the second pocket 17 when a Personal Digital Assistant is not present or it can be clipped onto the upwardly opening if a Personal Digital Assistant is stored in the second pocket 17. A hook 20 is located at the intermediate 31, aligned with the upwardly opening of the second pocket 17 and the third pocket 18. The hook 20 can be made of a rigid material to accommodate the weight of a key ring. Attached to the upwardly opening of the third pocket 17 and at a substantial distance from the intermediate is a loop 19. The loop 19 can be constructed of the same fabric as the handbag 70 with velcro or a comparable fabric attached to each end of the loop to provide quick release and storage of a coiled cell phone headset.

Figure 6:
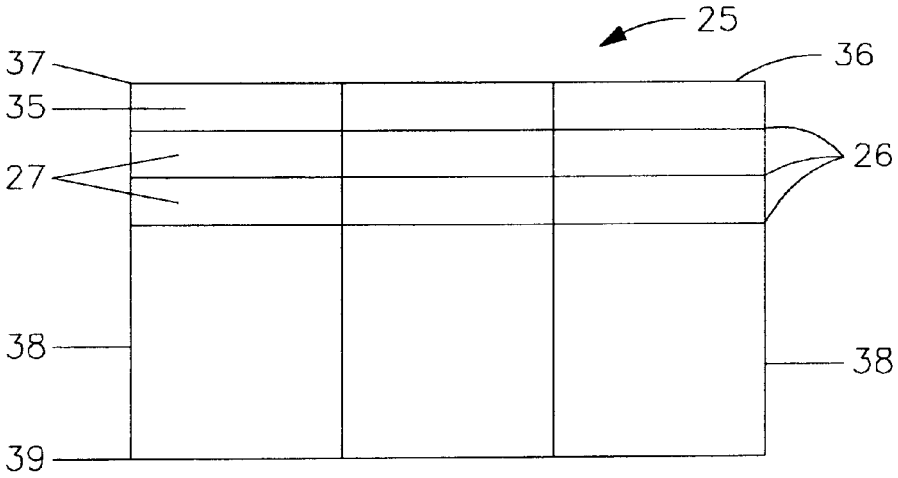
FIG. 6 is a perspective view of one side of the removable two-sided cardholder.

As shown in FIG. 6, a removable two-sided cardholder 25 is the removable storage component of the main structure of the handbag body. The removable two-sided cardholder 25 is formed by a cardholder front panel 35 and a cardholder rear panel 36 and is constructed with the same material as the handbag 70. The front panel 35 and rear panel 36 can be sewn or heat bonded at the cardholder top edge 37, the cardholder side edges 38, and the cardholder bottom edge 39. The panels 35 and 36 should be reinforced with a relatively rigid or semi-rigid backing material such as cardboard, vinyl, or the like. The removable two-sided cardholder 25 is of the type generally found in a standard wallet and has a plurality of credit card pockets 26, on panels 35 and 36, vertically arranged in an overlapping, tier like fashion each having an opening for receiving a credit card or similar object. The credit card pockets 26 are formed with a plurality of flaps 27 each having four peripheral edges, three of which are permanently attached to panels 35 and 36. The second flap overlays the first flap such that its unattached fourth peripheral edge provides the opening and is spaced a predetermined distance from the unattached peripheral edge of the first flap to form a credit card holding space. The remaining flaps are arranged in a similar manner. The removable two-sided cardholder 25 can be inserted into the first pocket 16, shown in FIG. 4.

Figure 5:
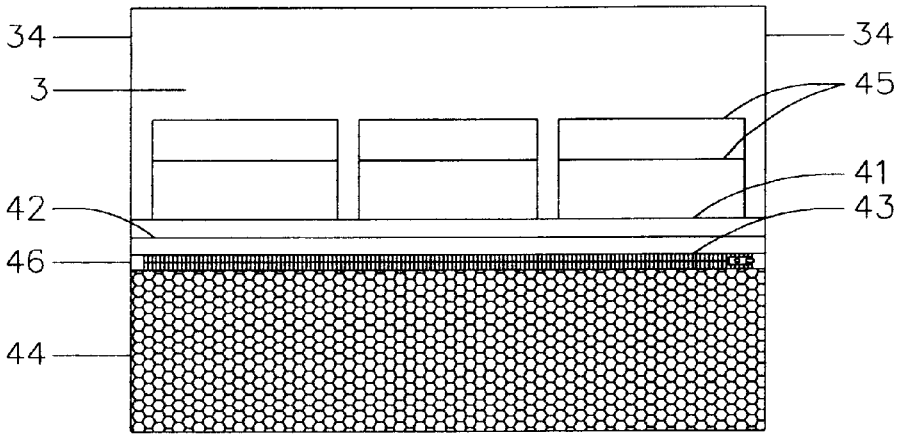
FIG. 5 is a sectional view taken along line 5—5 of FIG. 2.

The details of the inner side front panel 3, as shown in FIG. 5, are now discussed. Within the interior compartment and attached to the inner side front panel is a plurality of pockets 45. The plurality of pockets 45 are constructed in the same fashion as the credit card pockets 26 found on the removable two-sided cardholder 25 shown in FIG. 4. Overlying the plurality of pockets 45 are a further series of elongated overlapped strips of progressive reduced height with respect to the lower row of plurality of pockets 45. Each strip is secured peripherally at the front panel side edge 34 and at the bottom of the inner side front panel 3. The respective strips therefore shown in FIG. 5 define a fourth pocket 41 for the storage of a checkbook and passport, a fifth pocket 42 for the storage of U.S. paper currency, and a sixth pocket 43 for storage of items pending. Overlying sixth pocket 43 is an elongated strip of mesh fabric that is of equal height to the sixth pocket 43 and is secured to all end portions of the sixth pocket 43. A zipper type fastening mechanism 46 extends across the upper edge to form a seventh pocket 44 for storing coins and other personal items. The mesh is made of an elastic synthetic material such as nylon but can also be made from natural fibers. The advantage of a mesh pocket is that small items can be securely held and easily viewed.

Operation of Invention

Figure 3:
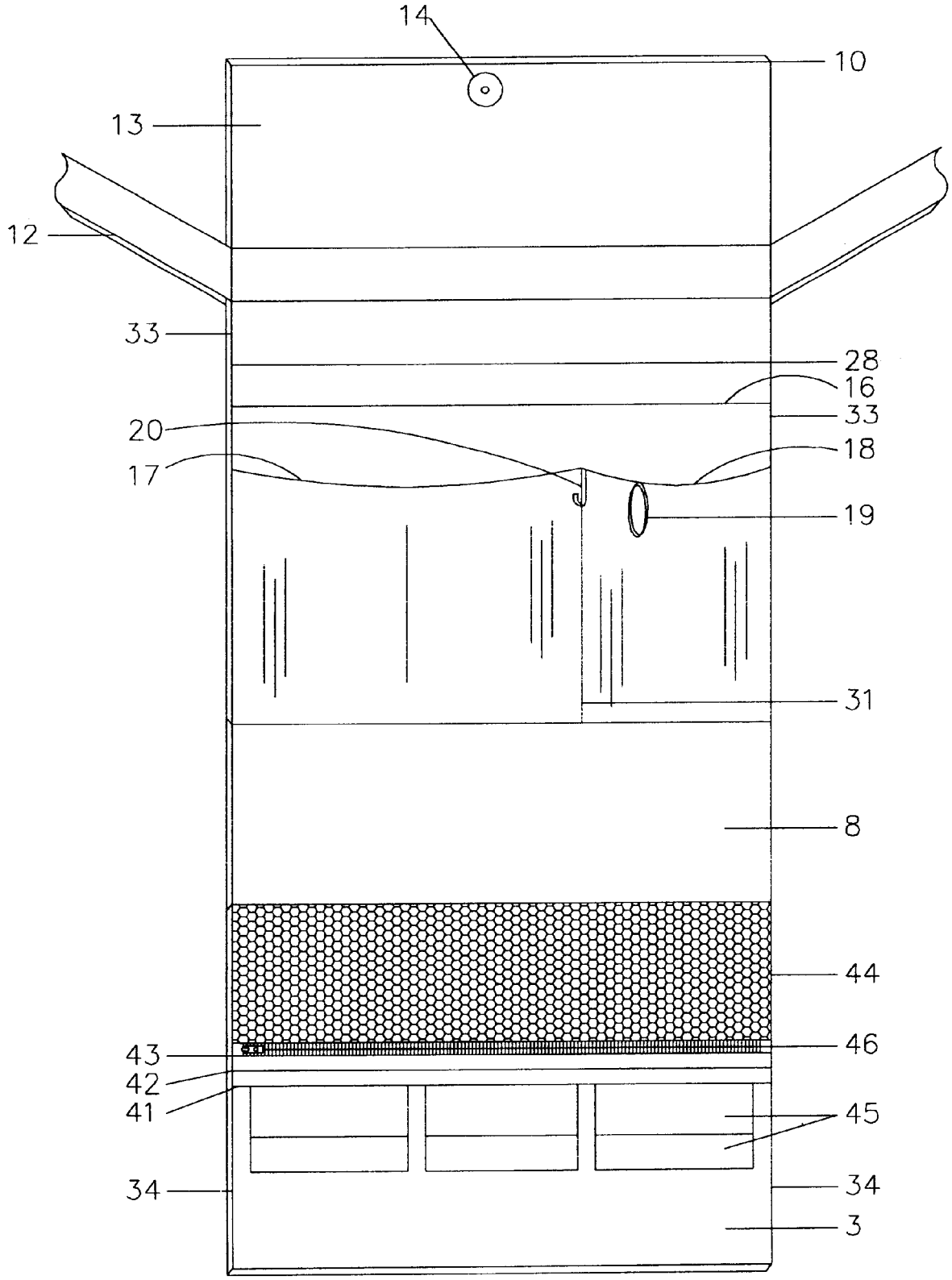
FIG. 3 is a plan view of the handbag of FIG. 2 opened into a single plane.

The manner of using the Mobile Technology Organizer Handbag with one hand is similar to that of many handbags with a magnetic closure. As shown in FIG. 1, the user can place a finger under the lower edge closure flap 11 and gently pull. The magnetic snap closure half 14 will easily release from the cooperative snap closure half 15, shown in FIG. 2. Once the closure flap 10 is in the open position, shown in FIG. 2, the contents of the inner side rear panel 6 and the inner side front panel 3, shown in FIG. 3 can be viewed and accessed with one hand while the handbag remains on the user's shoulder.

As shown in FIG. 6, credit card sized items can be retrieved from the credit card pockets 26 of the two-sided cardholder 25 by using a thumb or two fingers to slide the card out of the credit card pocket 26. The credit card sized items can be replaced into the credit card pockets 26 in the same manner. As shown in FIG. 4, the two-sided cardholder 25 is removed from the first pocket 16 by grasping the cardholder top edge 37 and pulling in the direction of the user's shoulder. The Personal Digital Assistant can be removed from the second pocket 17 by grasping the portion of the Personal Digital Assistant that extends out from the upwardly opening of the second pocket 17 and pulling in the direction of the user's shoulder. Holding the top of the device with two fingers, placing the bottom of the device into the upwardly opening of the second pocket 17 and pushing gently until the bottom of the Personal Digital Assistant touches the bottom panel 8 can replace the Personal Digital Assistant. The cell phone can be removed from the third pocket 18 by grasping the portion of the cell phone that extends out from the opening of the third pocket 18 and pulling in the direction of the user's shoulder. Holding the top of the device with two fingers, placing the bottom of the device into the upwardly opening of the third pocket 18 and pushing gently until the bottom of the cell phone touches the bottom panel 8 can replace the cell phone. The key ring can be removed from the hook 20 by grasping any portion of the key ring or any number of keys and pulling toward the user's shoulder. The key ring can be replaced onto the hook 20 by grasping any portion of the key ring or any number of keys and placing the ring portion of the key ring onto the hook. The cell phone headset can be removed from the loop 19 by taking one finger and pulling the end of the loop not attached to the third pocket 18 into the direction of the bottom panel 8. This will release the Velcro that keeps the loop 19 in a closed position. Simultaneously and with a second finger the coiled headset can be removed while maintaining its coiled position so the user can easily grab one end of the headset to be plugged into the phone and grab the other end of the headset to place inside the ear. Maintaining the coiled position eliminates the headset wire from dangling and potentially getting entangled with other objects. Coiling the headset and taking the end of the loop 19 not attached to the third pocket 18 and slipping it through the opening provided by the coil can replace the cell phone headset. The end of the loop 19 not attached to the third pocket 18 can then be placed against the other half of the loop and pushed gently to ensure the Velcro components have met.

In FIG. 5, the credit card sized items can be retrieved from the pockets 45 by using a thumb or two fingers to slide the card out of the credit card pocket 26. The credit card sized items can be replaced into the pockets 45 in the same manner. A checkbook can be removed from the fourth pocket 41 by inserting two fingers into the pocket, grasping the checkbook and pulling it toward the user's shoulder. The check can be placed inside the fourth pocket 41 with two fingers by spreading the fourth pocket 41 open while simultaneously pushing the checkbook until it touches the bottom of the fourth pocket 41. Paper currency can be removed from the fifth pocket 42 by inserting two fingers into the pocket, grasping the paper desired and pulling it toward the user's shoulder. Paper currency can be placed inside the fifth pocket 42 with two fingers by spreading the fifth pocket 42 open while simultaneously pushing the paper currency until they touch the bottom of the fifth pocket 41. Miscellaneous items can be removed from the sixth pocket 43 by inserting two fingers into the pocket, grasping the items desired and pulling it toward the user's shoulder. Miscellaneous items can be placed inside the sixth pocket 43 with two fingers by spreading the sixth pocket 43 open while simultaneously pushing the item until it touches the bottom of the sixth pocket 43. Coins and other items can be removed from the seventh pocket 44 by grasping the zipper type fastening mechanism 46 and pulling it into the open position. The same fingers used to open the zipper type fastening mechanism 46 can be placed inside the pocket to retrieve the items desired. The zipper type fastening mechanism 46 can then be pulled into the opposite direction to close the seventh pocket 44 so that the remaining contents remain secure. The exact same procedure is used to insert items into the seventh pocket 44.

Conclusion, Ramifications, and Scope

Thus the reader will see that the handbag of the invention provides an organizer for the busy, fashion conscious woman who continually strives to simplify her life, due to the demands of both family and career, by looking for ways to reduce clutter and become more efficient. As women increasingly rely on mobile technology and accessories such as cell phones, cell phone headsets and Personal Digital Assistants to be more efficient, a handbag with pockets sized and configured to hold these devices for single-handed, quick access can be important to help become more efficient and reduce frustration. Furthermore, the Mobile Technology Organizer Handbag has the additional advantages in that:

- it provides ample space to carry unique, personal items;
- it can transition from day-to-evening with its classic exterior style;
- it can open and close with one hand in a single, swift movement;
- it has a top opening that is substantially wider than the base for easy viewing of and access to interior contents;
- it has multiple pockets sized and configured to holding multiple forms of identification and currency;
- it has an interior key chain hook that resides near the top opening and in the middle of the back panel for quick access and to maintain an even balance when the handbag is carried on the shoulder; and
- it has a top closure that covers the interior contents and it eliminates exterior pockets for safety reasons.

Although my above description contains many specificities, these should not be construed as limitations on the scope of the invention, but as merely providing illustrations of some of the preferred embodiments of this invention. For example, the key ring can have other shapes, such as an enclosed circular closure similar to the cell phone headset holder; the cell phone headset holder can be located anywhere on or near the cell phone pocket; the Personal Digital Assistant pocket can accommodate a pager; the intermediate can accommodate another type of holder such as a writing pen, a pair of glasses, or lipstick; the side edges of the inner side front panel pockets can be attached to the inner side front panel with gussets for extra room; a pocket similar to the hidden insert pocket can be attached to the outer side back panel for temporary items that are desired to be stored and retrieved without intermingling with the regular contents of the handbag or without opening the handbag, the shoulder strap can be an adjustable shoulder strap, etc.

Accordingly, the scope of the invention should be determined not by the embodiment(s) illustrated, but by the appended claims and their legal equivalents.

I claim:

1. A handbag comprising:

a pair of opposed front and rear panels, wherein the front and rear panels are substantially rigid and rectangular in shape, with each panel having opposing upper and lower panel edges and opposing side panel edges, a plurality of internal pockets on at least one of the panels;

a pair of opposed gussets joined to the front and rear panels, each gusset having opposing upper and lower gusset edges and opposing side gusset edges, the side gusset edges joined to the respective side panel edges of the front and rear panels, and wherein the upper gusset edges are longer than the lower gusset edges;

a bottom panel joined to the front and rear panels and the gussets, the bottom panel being substantially rigid and rectangular in shape and having opposing side bottom panel edges and opposing first and second bottom panel edges, the first and second bottom panel edges joined to the respective lower panel edges of the front and rear panels, and the side bottom panel edges joined to the respective lower gusset edges of the gussets;

a pliable closure flap joined to the rear panel, the closure flap having opposing upper and lower closure flap edges and an underside face, the upper closure flap edge joined to the upper panel edge of the rear panel, and the closure flap being movable between an open position in which contents of the handbag are viewable and accessible by a user through a top opening of the handbag and a closed position in which a portion of the closure flap extends onto and is releaseably secured to the front panel, closing the top opening; and a shoulder strap attached to the closure flap to allow the handbag to be supported on a shoulder of a user, the shoulder strap being attached to the underside face of the closure flap, intermediate the upper and lower closure flap edges of the closure flap, whereby release of the closure flap from the front panel results in relative movement between the closure flap and the rear panel with the closure flap pivoting about the upper panel edge to the open position, opening the handbag while the handbag remains on the user's shoulder.

2. The handbag of claim 1, wherein the top opening is substantially wider than the bottom panel when the closure flap is in the open position.

3. The handbag of claim 1, wherein the plurality of internal pockets comprise a first set of pockets on the rear panel and a second set of pockets on the front panel, the first set of pockets including at least a first pocket that is adapted to hold a two-sided credit card holder, wherein the two-sided credit card holder consists essentially of a rigid panel that on each side includes three side-by-side columns of overlapping credit card pockets, wherein each credit card pocket (i) has a width that is about the width of a credit card, and (ii) is adapted to hold a credit card, and the second set of pockets including at least a second pocket that includes an outer mesh fabric and a zipper.

4. The handbag of claim 1, wherein the front panel includes a first closure member and the closure flap includes a second closure member carried by the underside face of the closure member and cooperating with the first closure member to releasably secure the closure flap to the front panel when the closure flap is in the closed position.

5. The handbag of claim 1, wherein the plurality of pockets include at least one pocket for holding a mobile technology device, the pocket having a pocket opening for receiving the mobile technology device and the pocket being formed from a stretch fabric which defines the pocket opening and which flexibly holds the mobile technology device in the pocket, allowing quick and easy removal of the mobile technology device from the pocket through the pocket opening and quick and easy replacement of the mobile technology device into the pocket through the pocket opening.

6. The handbag of claim 5, and including a storage loop located adjacent to the pocket, the storage loop having first and second ends and being sized and structured to releaseably hold an accessory for use with the mobile technology device, the first end releasable from and securable to the second end to allow quick removal of the accessory from the storage loop and subsequent replacement of the accessory on the storage loop.

7. The handbag of claim 5, wherein the mobile technology device is a personal digital assistant.

8. The handbag of claim 5, wherein the mobile technology device is a cell phone.

9. The handbag of claim 8, and including a storage loop located adjacent to the pocket, the storage loop sized and structured to releaseably hold a headset for use with the cell phone, the storage loop including an end that is releasable to allow quick removal of the headset from the storage loop and subsequent replacement of the headset on the storage loop.

10. A handbag comprising:

a pair of opposed front and rear panels, the front and rear panels being substantially rigid and rectangular in shape with each panel having opposing upper and lower panel edges and opposing side panel edges;

a pair of opposed pliable gussets joined to the front and rear panels, each gusset having opposing upper and lower gusset edges and opposing side gusset edges, the side gusset edges joined to the respective side panel edges of the front and rear panels, the upper gusset edges being longer than the lower gusset edges;

a bottom panel joined to the front and rear panels and the gussets, the bottom panel being substantially rigid and rectangular in shape and having opposing side bottom panel edges and opposing first and second bottom panel edges, the first and second bottom panel edges joined to the respective lower panel edges of the front and rear panels, and the side bottom panel edges joined to the respective lower gusset edges of the gussets;

a pliable closure flap joined to the rear panel, the closure flap having opposing upper and lower closure flap edges and an underside face, the upper closure flap edge joined to the upper panel edge of the rear panel, and the closure flap being movable between an open position in which contents of the handbag are viewable and accessible by a user through a top opening of the handbag and a closed position in which a portion of the closure flap extends onto and is releaseably secured to the front panel and closes the top opening;

a shoulder strap attached to the closure flap, allowing the handbag to be supported on a shoulder of a user and to be opened by the user with one hand to provide the user with viewing of and access to contents of the handbag, at least one of the panels including first and second pockets for holding first and second mobile technology devices, respectively, the first and second pockets having first and second openings, respectively, for receiving the first and second mobile technology devices, respectively, the first and second pockets being formed from a stretch fabric which defines the first and second openings and which flexibly holds the first and second mobile technology devices, respectively, in the pockets while allowing both quick and easy removal of the first and second mobile technology devices from the pockets through the respective first and second openings and quick and easy replacement of the first and second mobile technology devices into the pockets through the respective first and second openings, and a storage loop adjacent to the first pocket, the storage loop being sized and structured to hold an accessory for use with the first mobile technology device, the storage loop including an end that is releasable to allow quick removal of the accessory from the storage loop and subsequent replacement of the accessory on the storage loop.

11. The handbag of claim 10, wherein the mobile technology device is a cell phone and the accessory is a headset for use with the cell phone.

12. The handbag of claim 10, wherein the mobile technology device is a personal digital assistant.

13. A handbag comprising:

a pair of opposed front and rear panels, the front and rear panels being substantially rigid and rectangular in shape with each panel having opposing upper and lower panel edges and opposing side panel edges;

a pair of opposed pliable gussets joined to the front and rear panels, each gusset having opposing upper and lower gusset edges and opposing side gusset edges, the side gusset edges joined to the respective side panel edges of the front and rear panels, the upper gusset edges being longer than the lower gusset edges;

a bottom panel joined to the front and rear panels and the gussets, the bottom panel being substantially rigid and rectangular in shape and having opposing side bottom panel edges and opposing first and second bottom panel edges, the first and second bottom panel edges joined to the respective lower panel edges of the front and rear panels, and the side bottom panel edges joined to the respective lower gusset edges of the gussets;

at least one of the panels including a first pocket for holding a cell phone and a second pocket for holding a personal digital assistant, the first and second pockets having first and second openings, respectively, for receiving the cell phone and the personal digital assistant, respectively, and the first and second pockets being formed from a stretch fabric which defines the respective first and second openings and which flexibly holds the cell phone and the personal digital assistant, respectively, in the pockets while allowing both quick and easy removal of the cell phone and the personal digital assistant from the pockets through the first and second openings, respectively, and quick and easy replacement of the cell phone and the personal digital assistant into the pockets through the first and second openings, respectively;

a storage loop on said one panel located adjacent to the first pocket, the storage loop sized and structured to hold a headset for use with the cell phone, the storage loop including an end that is releasable to allow quick removal of the headset from the storage loop and subsequent replacement of the headset on the storage loop;

a pliable closure flap joined to the rear panel, the closure flap having opposing upper and lower closure flap edges and an underside face, the upper closure flap edge joined to the upper panel edge of the rear panel, and the closure flap being movable between an open position in which contents of the handbag are viewable and accessible by a user through a top opening of the handbag and a closed position in which a portion of the closure flap extends onto and is releaseably secured to the front panel, closing the top opening; and a shoulder strap attached to the closure flap to allow the handbag to be supported on a shoulder of a user, the shoulder strap being attached to the underside face of the closure flap, intermediate the upper and lower closure flap edges, whereby release of the closure flap from the front panel results in relative movement between the closure flap and the rear panel with the closure flap pivoting about the upper panel edge to the open position, opening the handbag while the handbag remains on the user's shoulder, and wherein the top opening is substantially wider than bottom panel.

* * * * *